US005171017A

United States Patent [19]

Betancourt

[11] Patent Number: 5,171,017

[45] Date of Patent: Dec. 15, 1992

[54] GOLF ALIGNMENT AID

[75] Inventor: Alberto Betancourt, Pikeville, N.C.

[73] Assignee: Beta Systems, Inc., Goldsboro, N.C.

[21] Appl. No.: 819,122

[22] Filed: Jan. 10, 1992

[51] Int. Cl.[5] ..... A63B 69/36

[52] U.S. Cl. ..... 273/187 R; 33/508; 273/186.1

[58] Field of Search ..... 273/187 R, 187 A, 187 B, 273/183 A, 183 F, 186 C, 186 B; 33/508; 434/252

[56] References Cited

U.S. PATENT DOCUMENTS

| | | | |
|---|---|---|---|
| 2,777,697 | 1/1957 | Crossot | 273/187 R |
| 4,434,983 | 3/1984 | Taggart | 273/187 R |
| 4,544,161 | 10/1985 | Guendling | 273/187 A |
| 4,915,387 | 10/1990 | Baxstrom | 273/187 A |
| 5,014,994 | 5/1991 | Peters | 273/187 R |

*Primary Examiner*—George J. Marlo
*Attorney, Agent, or Firm*—Olive & Olive

[57] ABSTRACT

A golf alignment aid having a one-piece club alignment piece and a one-piece elongated foot alignment piece. The club alignment piece has two alignment grids along a first edge. The alignment grids have marks to indicate which wood or iron golf club should be used. A golf club directional portion having a ball placement cutout area which is circumscribed by the club alignment piece is placed on the club alignment piece parallel to the first edge. The elongated edges of the foot alignment piece are used for heel placement and a series of toe alignment lines parallel to each other and perpendicular to the elongated heel placement edges are used for alignment of the golfer's two feet. In use, the foot alignment piece is placed perpendicular to the first edge and a designated elongated edge is aligned with the marks on the alignment grid corresponding to the golf club to be used. Either the first elongated heel placement edge is aligned with marks in the first alignment grid or the second elongated heel placement edge is aligned with marks in the second alignment grid. Instructions on the foot alignment piece tell the golfer which heel to align with the placement edge.

6 Claims, 3 Drawing Sheets

GOLF ALIGNMENT AID

BACKGROUND OF THE INVENTION

1. Field of the Invention

This invention relates to golfing aids, and in particular, pertains to aids for aligning a golfer's feet so that the golf ball is correctly hit.

2. Description of the Related Art

Golfing requires selection of an appropriate golf club for the distance between the golf ball and the target area where the ball is to be hit, proper alignment of the golfer's body and proper swing of the golf club. Although golfing techniques taught by professionals may be excellent, it is difficult for a beginning golfer to put these techniques into practice on the golf course.

Many different golfing aids have been devised to teach golfers to address and hit a golf ball properly when using different sizes and types of golf club. Many of these aids are of rigid material or are large and do not adapt do an irregular ground surface. Others do not provide for differences in golf club size or type.

The patent of Taggart (U.S. Pat. No. 4,434,983) provides a rectangular mat with a tee bar mounted to the upper surface thereof. The tee bar has a base strip which defines the swing path and has a scale to indicate tee positions. An integral center strip extends at right angles to the base strip and bears a scale with pin placement holes for aligning a triangular feed placement guide.

The patent of Guendling, Jr. (U.S. Pat. No. 4,544,161) is for a training aid for hitting a golf ball. The aid is a unitary, integrally formed, rigid, T-shaped planar member. The top of the "T" has a series of holes for placement of tees.

The golf practice and training device of Baxstrom (U.S. Pat. No. 4,915,387) is a rectangular mat having positions marked for placement of the feet, a shoulder alignment line; and a plurality of target aiming lines.

It is therefore an object of this invention to provide a golf alignment aid for golfing beginners, so that they can learn how to position their bodies and the golf club with respect to the position of the golf ball and the target area where the ball is to be hit.

It is a further object of this invention to provide a golf alignment aid which assists in determination of which golf club to use and is useful with different wood and iron clubs.

It is a further object of this invention to provide a golf alignment aid which is flexible and easy to handle.

Other objects and advantages will be more fully apparent from the following disclosure and appended claims.

SUMMARY OF THE INVENTION

The invention provides a golf alignment aid having a club alignment piece and an elongated foot alignment piece. The club alignment piece has at least two alignment grids along a first edge thereof. The alignment grids have marks to indicate which wood or iron golf club should be used. A golf club directional portion having a ball placement cutout area is placed on the club alignment piece parallel to the first edge. Elongated edges of the foot alignment piece are used for heel placement. A series of toe alignment lines parallel to each other and perpendicular to the elongated heel placement edges are used for alignment of the golfer's two feet. In use, the foot alignment piece is placed perpendicular to the first edge and a designated elongated edge is aligned with the marks on the alignment grid corresponding to the golf club to be used. Instructions on the foot alignment piece tell the golfer which heel of a golfer to align with the placement edge.

Other aspects and features of the invention will be more fully apparent from the following disclosure and appended claims.

DETAILED DESCRIPTION OF THE INVENTION AND PREFERRED EMBODIMENTS THEREOF

Figure 1:
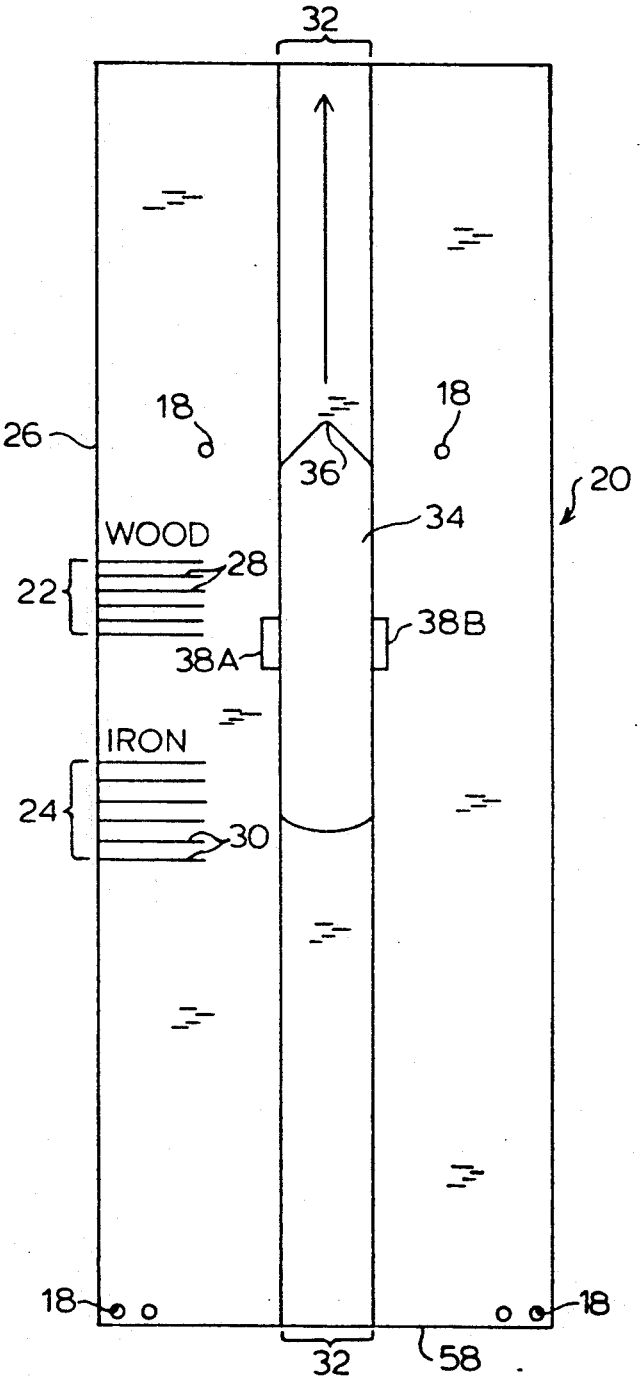
FIG. 1 is a top planar view of a club alignment piece according to the invention.

The present invention provides a golf alignment aid, comprising:

(a) a club alignment piece comprising:

(i) a first and a second alignment grid along a first edge of said club alignment piece; said first alignment grid containing a plurality of marks for using any of a plurality of corresponding wood golf clubs, and said second alignment grid containing a plurality of marks for using any of a plurality of corresponding iron golf clubs;

(ii) a golf club directional portion parallel to said first edge, said golf club directional portion having a ball placement cutout area; and (iii) a ball placement indication on said club alignment piece adjacent said ball placement cutout area; and (b) a foot alignment piece having a first and a second elongated heel placement edge and carrying a series of toe alignment lines parallel to each other and perpendicular to the elongated heel placement edges; wherein said elongated foot alignment piece may be placed in a position wherein:

(i) said elongated heel placement edges are perpendicular to said golf club directional portion; and either (ii) said first elongated heel placement edge is aligned with any of the marks in said first alignment grid and a first heel of a golfer is placed adjacent said first elongated heel placement edge; or (iii) said second elongated heel placement edge is aligned with any of the marks in said second alignment grid and a second heel of a golfer is placed adjacent said second elongated heel placement edge.

The golfer's alignment aid of the invention preferably also comprises indicia on the club alignment piece indicating which golf clubs to use for various ball distances from a ball target area. The club alignment piece also preferably has an end farthest from a ball target area indicating how far a golf club being should extend backwards away from the ball target area behind a ball placed in the ball placement cutout area next to the ball placement indication.

Both pieces of the invention have positioning holes for holding each of said pieces in place on a golfing surface such as grass or earth. The golfer may use thin metal tent stakes, spikes, golf tees, or any other means known in the art to place through the holes into the earth beneath the two pieces to hold them in place.

The method of aligning a golfer's feet and golf club swing to hit a ball from a ball position to a target area according to the invention utilizes the golf aid of the invention. The golfer determines the distance between the ball and the target area, for example, a hole on a golf course or a selected site on the golf course. Utilizing either knowledge about golf clubs, or markings which are preferably on the club alignment piece, the golfer determines which golf club to use for the determined distance. Depending on whether the golfer selects an iron or a wood, the golfer uses the corresponding grid, and the marking within the grid which designates the particular wood or iron to be used for that distance. The golfer then places the foot alignment piece so that it is perpendicular to the golf club directional portion, and the appropriate edge of the foot alignment piece is aligned with the selected mark on the grid. The golfer aligns the appropriate heel with the edge, and uses the toe alignment line to align the other foot.

Figure 2:
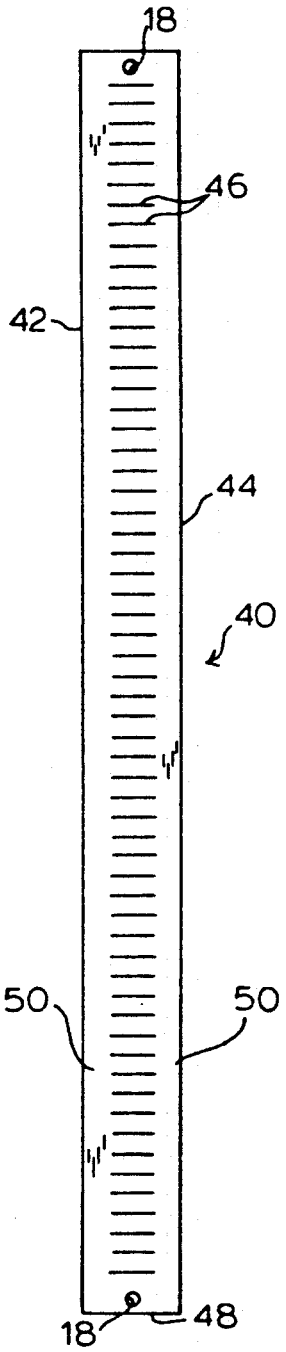
FIG. 2 is a top planar view of a foot alignment piece according to the invention.

Referring now to the Figures, the main structural components of the invention are a club alignment piece 20 (FIG. 1) and an elongated foot alignment piece 40 (FIG. 2). Both of these pieces 20, 40 have positioning holes 18 positioned at appropriate places for holding the pieces to the ground or other horizontal surface. Preferably there are positioning holes 18 at each corner of the club alignment piece 20, at least one positioning hole 18 at each end of the foot alignment piece 40.

The club alignment piece 20 of the invention is shown in FIG. 1. The club alignment piece 20 is generally rectangular and preferably has dimensions of about 33 inches by about 12–12¼ inches. A first alignment grid 22 and a second alignment grid 24 are located along a first edge 26 of the club alignment piece. The first alignment grid 22 is located just to the left of the center of the lower edge and the second alignment grid 24 is located just to the right of the center of the lower (first) edge 26.

The first alignment grid 22 comprises a plurality of wood marks 28 extending perpendicularly from the first edge 26 and spaced about ⅜ inch apart. Each wood mark 28 is preferably labeled with the number of the wood club (hereafter "wood") so that the wood mark 28 which is the closest of the wood marks 28 to the center of first edge 26 is labeled with wood 1, and the wood club label numbers increase so that the wood club mark 28 which is farthest from the center of first edge 26 is labeled with wood 5. The wood marks 28 are also labeled with the distance from the target area in sequence so that the labels are for 230, 220, 210, 200, and 190 yards for the wood marks 28 going from the wood mark 28 closest to the center of first edge 26 to the wood mark 28 farthest from the center of first edge 26. The wood marks 28 may also be labeled with tee height to be used with the various clubs, e.g., 1, ¾, ½, ¼ and 0 inches, respectively.

The second alignment grid 24 comprises a plurality of iron marks 30 also extending perpendicularly from the first edge 26 and spaced about ½ inch apart. Each iron mark 30 is also preferably labeled with the number of irons 4–9, so that of the labels for the irons, the label for iron number 9 at the iron mark 30 is closest to the center of the first edge 26, and the label for iron number 4 at the iron mark 30 is farthest from the center of first edge 26. The iron marks 30 are also labeled with the corresponding distance from the target which corresponds to the iron to use (110, 120, 130, 140, 150, 160 yards, respectively, for the iron marks 30, so that iron mark 30 closest to the center of first side 26 is labeled with 110 yards and the iron mark 30 farthest from the center of fist side 26 is labeled with 160 yards).

The club alignment piece 20 also has a golf club directional portion 32 marked on the piece and extending parallel to said first edge 26. The golf club directional portion is preferably about 2½ to 3 inches wide and is generally centered along the club alignment piece 20. Slightly closer to the left side of the club alignment piece 20 than the right side (when viewed as shown in FIG. 1) is a ball placement cutout area 34. The size of the cutout area 34 is sufficiently large to allow room for the golf club to move close to the ground near the ball without grazing the club alignment piece 20, but not so large as to weaken the club alignment piece 20. The cutout area 34 preferably extends within the golf club directional portion 32 from about 9–10 inches from the left side of the club alignment piece 20 to about no more than about 14 inches from the right side thereof. Thus, the ball placement cutout area 34 is about 10½×3 inches in size. Preferably the shape of the cutout area 34 tapers to a rounded arrow point 36 as shown in FIG. 1.

Adjacent the first alignment grid toward the center of the club alignment piece is a ball placement indication 38A marked on said club alignment piece 20 adjacent said ball placement cutout area 34. Directly across the ball placement cutout area 34 from ball indication 38A is a corresponding ball indication 38B. Each ball indication 38A,B is preferably about 1¼ inches long and is preferably centered about a point about 18 inches from the distal end 58 of the ball alignment piece 20. The centermost (along first edge 26) wood mark 28 is located along the first edge at a position about ⅝ inch from a position along the first edge 26 corresponding to the center of the ball indication 38A as shown in FIG. 1. The centermost iron mark 30 is located along the first edge 26 about 3 inches from the center of the ball indication 38A

As shown in FIG. 2, the second part of the invention is an elongated foot alignment piece 40 which is preferably about the same length as the club alignment piece 20. The foot alignment piece 40 has a first elongated heel placement edge 42 and a second elongated heel placement edge 44 parallel to the first elongated heel placement edge 42. A series of parallel toe alignment lines 46 are marked perpendicular to the elongated heel placement edges 42, 44. In an area approximately 5–9 inches from the distal end 48 of the foot alignment piece 40 is a heel placement area 50 on each side of the foot alignment piece 40.

Both the club alignment piece 20 and the foot alignment piece 40 may have additional markings on them to aid in use of the two pieces and to provide additional golfing advice and instruction to the person using the device and method of the invention. Certain markings are preferably used in the invention, but other markings conveying other knowledge in the art or phrased alternatively are contemplated as part of the invention herein.

Preferred markings include an indication within or near the golf club directional portion 32 that the golfer should follow through with his or her weight, and that the golfer's shoulders should be parallel to the lines defining the golf club directional portion 32. Preferably the golfer is also advised of other golfing strategy and technique as known in the art, for example, to look for fairway markers to determine distance and direction to the target area 54, on how to hold and position the golf club, how to stand, that all clubs should be swung at the same speed, and that a professional golfer should be consulted if the golfer has problems, for example, with grip, stance or swing. The markings also preferably include instructions on alignment of the club alignment piece 20 and the foot alignment piece 40, and on how to use the invention, as described in detail below.

Figure 3:
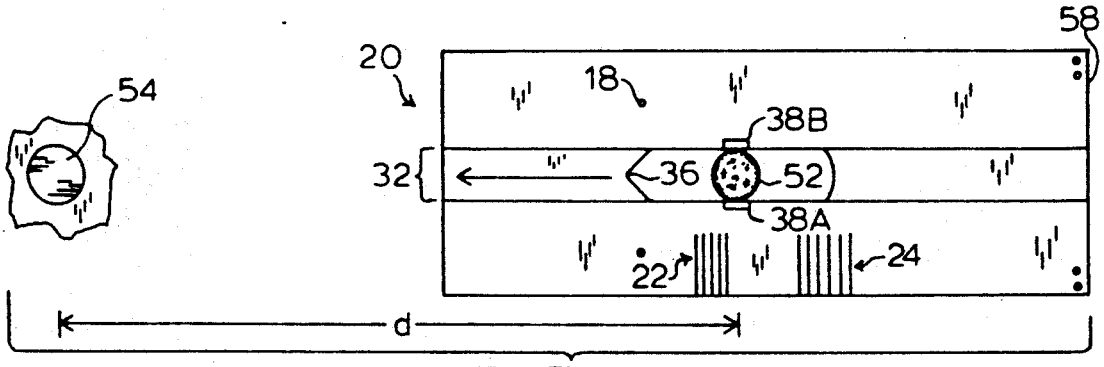
FIG. 3 is a top planar view of the club alignment piece of the invention positioned over a ball and aligned with respect to a target area.

In the method of the invention a club alignment piece 20 and a foot alignment piece 40 as described above are used. The golfer or golf learner places the ball placement cutout area 34 over the golf ball 52 lying on the ground, grass or other horizontal surface, with the ball 52 located between the ball placement indications and the point 36 located toward the target area 54 (FIG. 3). The corner positioning holes 18 on the club alignment piece 20 are used to hold it to the ground.

The golfer then determines, visually or by other means known in the art, the distance "d" between said ball position and a target area 54. The target area may be a cup, hole or other site, nearby or farther away, where the golfer wishes to the ball to be next.

After determining the distance, the golfer may consult a golf source of knowledge, and preferably uses the distance associated with a particular golf club which preferably is indicated on the club alignment piece 20 as discussed above. For example, if the distance is determined to be about 200 yards, the golfer would choose the number 4 wood. Similarly, if the distance is determined to be about 140 yards, the golfer would choose the number 6 iron.

Figure 4:
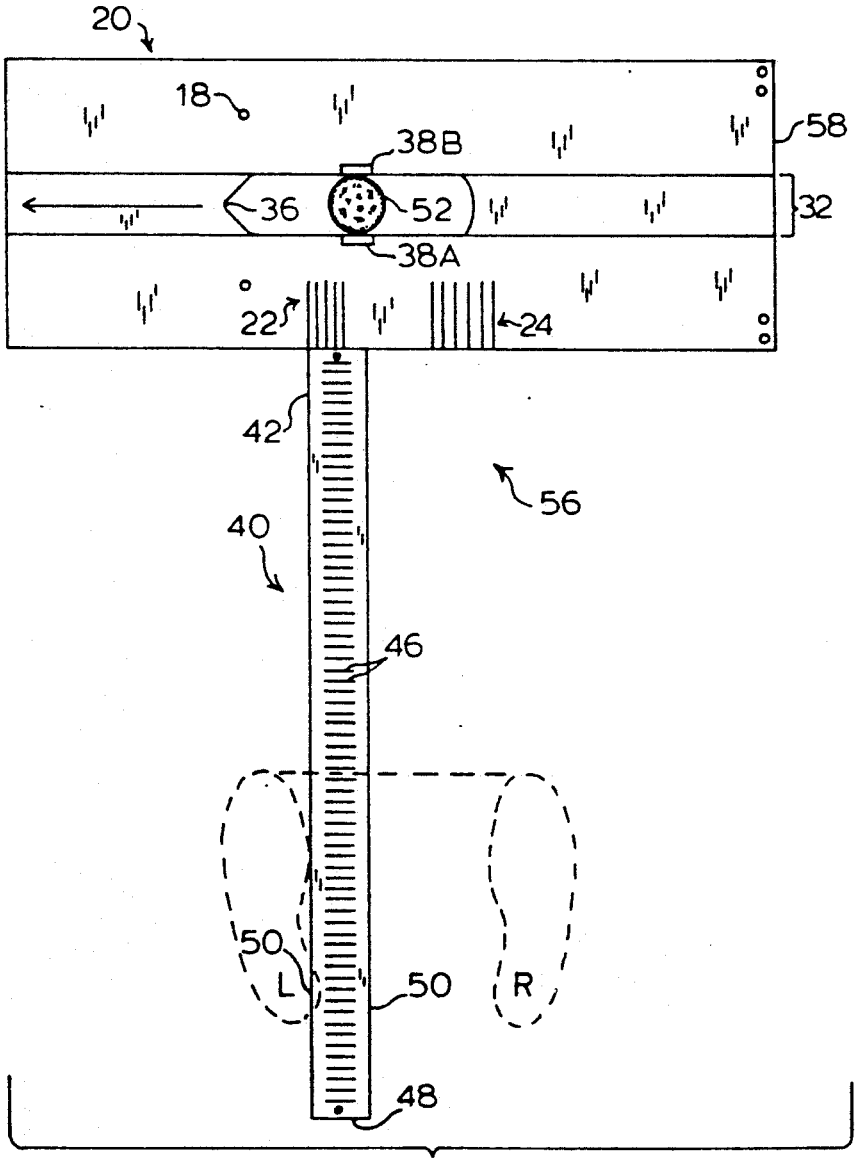
FIG. 4 is a top planar view of the golf alignment aid of the invention aligned for use with a wood golf club.

Once the golfer has selected the golf club, the next step is to align the foot alignment piece 40 correctly. If the selected golf club is a wood, the golfer aligns the first elongated heel placement edge 42 (left side of the foot alignment piece 40) with the wood mark 28 corresponding to the particular club. The foot alignment piece 40 extends perpendicularly from the club alignment piece in a "T" shape 56 as shown in FIG. 4, with the end opposite the distal end 48 being adjacent the club alignment piece 20. The golfer than places his or her heel of the left foot L at the first elongated heel placement edge 42 at heel placement area 50. The right foot R of the golfer is placed on the other side of the foot alignment piece 40. So that the golfer stands with shoulders aligned with the golf directional portion 32, the right foot R is placed, using the toe alignment lines 46, so that the toes are the same distance from the first edge 26 as the toes of the left foot L.

Figure 5:
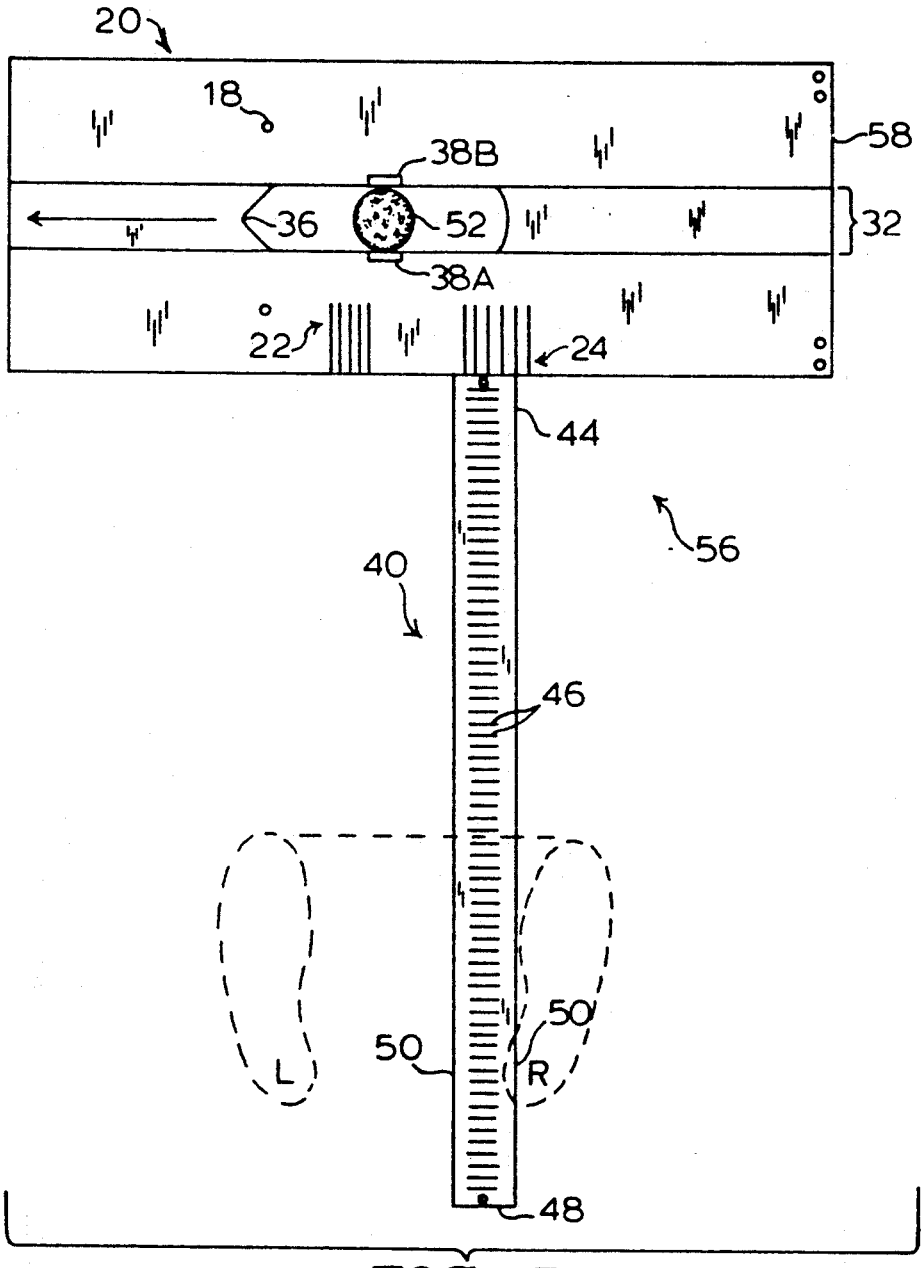
FIG. 5 is a top planar view of the golf alignment aid of the invention aligned for use with an iron golf club.

Alternatively, if the selected golf club is an iron, the golfer aligns the second elongated heel placement edge 44 (right side of the foot alignment piece 40) with the iron mark 30 corresponding to the particular club being used. The foot alignment piece 40 extends perpendicularly from the club alignment piece in a "T" shape 56 as shown in FIG. 5.

The golfer than places his or her heel of the right foot R at the second elongated heel placement edge 44 at heel placement area 50. The left foot L of the golfer is placed on the other side of the foot alignment piece 40. So that the golfer stands with shoulders aligned with the golf directional portion 32, the left foot L is placed so that the toes are the same distance from the first edge 26 as the toes of the right foot R using the toe alignment lines 46.

Once positioned, the golfer swings the club using motions known in the art, being sure to bring the club backward as far as the distal end 58 of the golf club directional portion 32, and then hitting the ball 52 and carrying through with the swing along the golf club directional portion 32 in the direction of the point 36 toward the target area 54.

The club alignment piece 20 and the foot alignment piece 40 are preferably made of a flexible, durable, water-resistant material such as rubber or plastic. Most preferably, these two pieces are made of sheets of a rubber laminate about ⅛" thick in which the rubber is laminated to or has inserted therein a cloth layer to increase tear-resistance of the rubber. A product which may be used to make the two pieces of the invention is BUILT-RITE TM which may be purchased from Raleigh-Durham Rubber & Gasket Co., Inc. (Raleigh, N.C.). Preferably the upper surface of the two pieces is smooth when placed in position for alignment.

It is clear from the above description that the pictured and described embodiment of the invention is for right handed persons. The invention may be made in mirror image to that described, or alternatively, each piece may be printed on each side so that when turned over it may be used for left handed persons.

The dimensions given herein are for persons of average height, arm length and leg length. Other dimensions may be appropriate for persons substantially smaller or larger than average.

While the invention has been described with reference to specific embodiments thereof, it will be appreciated that numerous variations, modifications, and embodiments are possible, and accordingly, all such variations, modifications, and embodiments are to be regarded as being within the spirit and scope of the invention.

What is claimed is:

1. A golf alignment aid, comprising:

(a) a one-piece club alignment piece comprising:

(i) a first and a second alignment grid along a first edge of said club alignment piece; said first alignment grid containing a plurality of marks for using any of a plurality of corresponding wood golf clubs, and said second alignment grid containing a plurality of marks for using any of a plurality of corresponding iron golf clubs;

(ii) a golf club directional portion parallel to said first edge, said golf club directional portion having a ball placement cutout area; and which is circumscribed by said club alignment piece; and (iii) a ball placement indication on said club alignment piece adjacent said ball placement cutout area; and (b) a one-piece elongated foot alignment piece having a first and a second elongated heel placement edge and carrying a series of toe alignment lines parallel to each other and perpendicular to the elongated heel placement edges;

wherein said elongated foot alignment piece may be used to align the feet of a golfer when said elongated foot alignment piece is placed in a position wherein:

(i) said elongated heel placement edges are perpendicular to said golf club directional portion; and either (ii) said first elongated heel placement edge is aligned with any of the marks in said first alignment grid and a first heel of said golfer is placed adjacent said first elongated heel placement edge; or (iii) said second elongated heel placement edge is aligned with any of the marks in said second alignment grid and a second heel of said golfer is placed adjacent said second elongated heel placement edge.

2. A golfer's alignment aid according to claim 1, further comprising wood marks and iron marks on said club alignment piece indicating which golf clubs to use for various distances between a ball and a ball target area. . .

3. A golfer's alignment aid according to claim 1, wherein said golf club direction portion is alignable with a first end toward a ball target area and has a distal end, wherein when the golf club directional portion is aligned with said first end toward said ball target area, the distal end is at a position which indicates how far a golf club should extend away from the ball target area when a ball is placed in the ball placement cutout area next to the ball placement indication.

4. A golfer's alignment aid according to claim 1, further comprising positioning holes in said club alignment piece and in said elongated foot alignment piece for holding each of said pieces in place on a golfing surface.

5. A method of aligning a golfer's feet and golf club swing to hit a ball from a ball position to a target area, said method comprising:

(a) a one-piece club alignment piece comprising:

(i) a first and a second alignment grid along a first edge of said club alignment piece; said first alignment grid containing a plurality of marks for using any of a plurality of corresponding wood golf clubs, and said second alignment grid containing a plurality of marks for using any of a plurality of corresponding iron golf clubs;

(ii) a golf club directional portion parallel to said first edge, said golf club directional portion having a ball placement cutout area circumscribed by said club alignment piece; and (iii) a ball placement indication on said club alignment piece adjacent said ball placement cutout area;

(b) positioning said club alignment piece so that said ball is adjacent said placement indication and said golf club directional portion is oriented along a line extending between said ball and said target area;

(c) providing an elongated foot alignment piece having a first and a second elongated heel placement edge and carrying a series of toe alignment lines parallel to each other and perpendicular to the elongated heel placement edges, each of said elongated heel placement edges being designated for use with either wood or iron golf clubs;

(d) determining the distance between said ball position and said target area;

(e) using said determined distance to determine whether to use a wood or iron golf club and to determine which golf club to use;

(f) selecting the alignment grid corresponding to said golf club; and (g) placing said elongated foot alignment piece in a position wherein:

(i) said elongated heel placement edges are perpendicular to said golf club directional portion; and either (ii) a mark for the distance in the first alignment grid is aligned with the first elongated heel placement edge and a first heel of a golfer is placed adjacent said first elongated heel placement edge and a second foot of the golfer is placed using the toe alignment lines so that the toes of each foot are equidistant from the first edge; or (iii) a mark for the distance in the second alignment grid is aligned with the second elongated heel placement edge and a second heel of a golfer is placed adjacent said second elongated heel placement edge and a second foot of the golfer is placed using the toe alignment lines so that the toes of each foot are equidistant from the first edge.

6. A method for aligning a golfer's feet and golf club swing to hit a ball from a position to a target area according to claim 5, wherein the club to be used is determined from wood marks and iron marks placed on the club alignment piece.

* * * * *